US006006531A

United States Patent [19]

Pritts et al.

[11] Patent Number: 6,006,531

[45] Date of Patent: Dec. 28, 1999

[54] REFRIGERATOR TEMPERATURE CONTROL SYSTEM INCORPORATING FREEZER COMPARTMENT TEMPERATURE SENSOR

[75] Inventors: Todd E. Pritts; Richard D. Smith, Jr., both of Galesburg, Ill.

[73] Assignee: Maytag Corporation, Newton, Iowa

[21] Appl. No.: 09/129,241

[22] Filed: Aug. 5, 1998

[51] Int. Cl.[6] ..... F25D 17/08

[52] U.S. Cl. ..... 62/187; 62/229; 236/DIG. 19

[58] Field of Search ..... 62/187, 186, 180, 62/229, 408; 236/78 R, 78 B, DIG. 19

[56] References Cited

U.S. PATENT DOCUMENTS

| | | | |
|---|---|---|---|
| 2,866,323 | 12/1958 | Candor | 62/187 |
| 3,203,195 | 8/1965 | Armentrout et al. | 62/187 X |
| 3,893,307 | 7/1975 | Jacobs | 62/187 X |
| 4,732,009 | 3/1988 | Frohbieter | 62/89 |
| 5,385,032 | 1/1995 | Martin et al. | 62/187 |
| 5,419,148 | 5/1995 | Kuehl et al. | 62/208 |
| 5,870,900 | 2/1999 | Mohebbi et al. | 62/187 |
| 5,901,562 | 5/1999 | Tunzi et al. | 62/229 |

*Primary Examiner*—Harry B. Tanner
*Attorney, Agent, or Firm*—Everett G. Diederiks, Jr.

[57] ABSTRACT

A refrigerator temperature control system includes a passageway for delivering a supply of cooling air from a freezer compartment to a fresh food compartment. A diverter member is positioned about the passageway in the freezer compartment for channeling the air through the passageway. A freezer compartment temperature sensor is routed from a temperature control unit in the fresh food compartment, through a bore formed in an insert which defines the air passageway, into a specialized chamber formed as part of the diverter member. The chamber is in fluid communication with the flow of air to the fresh food compartment through a bleed hole. To increase its surface area, the sensor is preferably coiled within the chamber and an insulation jacket extends about the sensor from within the fresh food compartment, with the insulation jacket creating a seal within the bore. In addition, a supporting sleeve extends about the sensor between the temperature control unit and the coiled portion of the sensor.

20 Claims, 3 Drawing Sheets

43
121
129
127
114
26
86
83
138
140
157
136
160
144
92
98
131
95
102
123
133
62
100
67
96
63
90
-8-
97
125
146
150
-72-
166
76
77
22
74
70
53
57
59
56
52
125
102
114
127
123
133
22
74
131

REFRIGERATOR TEMPERATURE CONTROL SYSTEM INCORPORATING FREEZER COMPARTMENT TEMPERATURE SENSOR

BACKGROUND OF THE INVENTION

1. Field of the Invention

The present invention pertains to refrigerators having freezer and fresh food compartments which are separated by a partition and, particularly, to a temperature sensor for signaling freezer compartment temperatures to a temperature control unit. More specifically, the invention is directed to the positioning of the temperature sensor within a special compartment of an air flow control member used in directing cooling air to flow from the freezer compartment to the fresh food compartment.

2. Discussion of the Prior Art

In typical household refrigerators having partitioned freezer and fresh food compartments, air is generally circulated over an evaporator and then delivered to both the freezer compartment and the fresh food compartment. One or more user operated temperature controllers are provided in order to manually adjust the desired temperature ranges for the two compartments. In certain know prior art arrangements, the fresh food control is operatively connected to a thermostat unit which receives fresh food compartment temperature signals by means of a capillary tube or other type of sensor mounted within the fresh food compartment. With such a system, the fresh food control thermostatically maintains the fresh food compartment temperature by periodically energizing and de-energizing a compressor of a refrigeration circuit.

In such a known arrangement, it is also common to connect the freezer control to an air flow damper positioned in a passageway through which air is delivered from the freezer compartment to the fresh food compartment. As the freezer control is set to a cold position, the damper is manually moved to allow less air into the fresh food compartment and the fresh food control responds by increasing the active time of the compressor to maintain the temperature of the fresh food compartment while further cooling the freezer compartment. Conversely, if the freezer control is set to a less cold position, the damper moves to allow more air to be sent from the freezer compartment to the fresh food compartment and, correspondingly, the fresh food compartment control compensates by running the compressor less often.

A major disadvantage of this type of known refrigerator temperature control system is that the temperature of the freezer compartment is only indirectly controlled based on the temperature in the fresh food compartment. One proposed solution to this problem is to incorporate separate temperature sensors for the fresh food and freezer compartments respectively. More specifically, a first sensor would be routed from either a thermostat or a damper in the temperature control unit to a desired location in the fresh food compartment, while a second sensor is routed from the other of the thermostat or the damper in the control unit to the freezer compartment. Temperature signals from the second sensor would then be used to regulate the refrigeration cycling directly or to automatically set the position of the air flow damper such that a direct control response can be obtained.

In these types of refrigerator temperature control systems, positioning of the sensor can be crucial to the operation of the overall system. The known prior art has had limited success in maintaining a consistent positioning of the sensor and has generally placed the sensor directly in the air flow stream to the fresh food compartment. The positioning of the sensor in this manner can result in rather large temperature fluctuations depending upon the rate of flow of cooling air across the sensor. In addition, condensation and conduction to the portion of the sensor in the freezer compartment can also have an adverse impact on the accuracy of the temperature readings.

Based on the above, there exists a need in the art of refrigerators for an improved temperature control system which can accurately and directly respond to temperature variations in a refrigerator freezer compartment. More specifically, there exists the need for an improved freezer temperature sensing arrangement for use in a temperature control unit of a refrigerator.

SUMMARY OF THE INVENTION

The present invention is directed to a system for controlling temperatures in and the flow of air between freezer and fresh food compartments of a refrigerator. More specifically, the invention is concerned with regulating a flow of air to a freezer temperature sensor used to signal freezer temperatures to a system controller. In accordance with a preferred embodiment of the invention, the system includes a temperature control unit mounted in the fresh food compartment of the refrigerator and the freezer temperature sensor is routed from the control unit through a partition separating the freezer compartment and the fresh food compartment. A passageway is formed in the partition which allows cooling air to flow from the freezer compartment to the fresh food compartment. A diverter member is arranged at the passageway, with the diverter member defining a channel for guiding the cooling air to the passageway.

The housing of the diverter member is formed with a specialized chamber placed in fluid communication with the channel through a bleed hole extending through a common side wall of the channel and the chamber. The chamber also includes another hole which, in conjunction with the bleed hole, enables a regulated flow of air through the chamber. The partition is provided with a bore, spaced from the passageway, which leads to the chamber and through which a first end portion of the freezer temperature sensor projects into the chamber. In the most preferred form of the invention, the sensor is constituted by a capillary tube, with the first end portion of the sensor being coiled within the chamber to increase the surface area of the sensor within the chamber. An insulation sleeve is provided about the tube from within the fresh food compartment, with the sleeve being compressed at the bore in order to create a seal between the two refrigeration compartments. A sleeve is also arranged about the tube adjacent the coiled first end portion in order to assure a proper location of the first end portion.

Since the sensor is located within the specialized chamber, the sensor is protected from being inadvertently damaged due to contact with items placed in the freezer compartment. In addition, by the positioning of the sensor within the chamber and regulating the exposure of the sensor to the flow of cooling air, the sensor has been found to warm at a controlled rate such that the cycling of the refrigeration circuit can be minimized.

Additional objects, features and advantages of the temperature control system of the present invention will become more readily apparent from the following detailed description of a preferred embodiment thereof, when taken in conjunction with the drawings wherein like reference numerals refer to corresponding parts in the several views.

DETAILED DESCRIPTION OF THE PREFERRED EMBODIMENT

Figure 1:
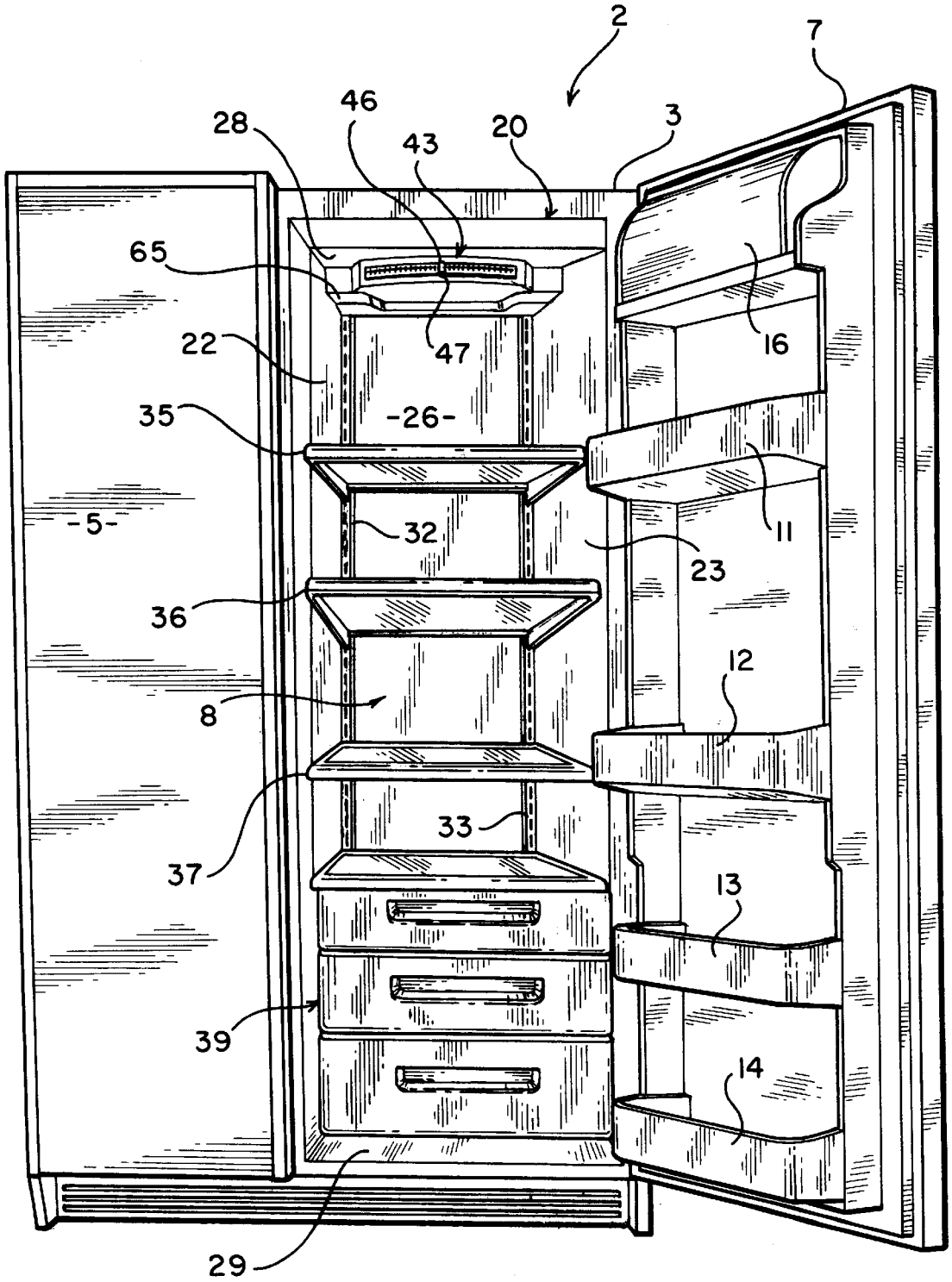
FIG. 1 is a front, generally elevational view of a side-by-side refrigerator incorporating the temperature control system of the present invention.

With initial reference to FIG. 1, a side-by-side refrigerator is generally indicated at 2. In a manner widely known in the art, side-by-side refrigerator 2 is formed from a cabinet shell 3 to which is pivotally attached a freezer compartment side door 5 and a fresh food compartment side door 7. Side door 7 is shown open to expose a fresh food compartment 8 defined within cabinet shell 3. Fresh food compartment side door 7 supports a plurality of vertically spaces shelves 11–14 and is also preferably provided with a dairy compartment 16. In the preferred embodiment, fresh food compartment 8 is formed from an integral liner 20 having opposed side walls 22 and 23, a rear wall 26 and top and bottom walls 28 and 29. Secured to rear wall 26 by means of mechanical fasteners (not shown) are a pair of laterally spaced and vertically extending rails 32 and 33 that adjustably support various vertically spaced shelves 35–37, as well as a shelf supporting bin assembly generally indicated at 39.

The present invention is particularly directed to a control system for regulating the temperatures within the compartments of side-by-side refrigerator 2. For this purpose, positioned atop fresh food compartment 8 is a temperature control unit 43. Temperature control unit 43 is preferably molded of plastic and secured to top wall 28 of liner 20 at an upper rear portion of fresh food compartment 8. As illustrated, temperature control unit 43 includes upper and lower slidable temperature control members 46 and 47 which can be used by a consumer to adjust the temperatures within side-by-side refrigeration 2 to preferred levels. In the preferred embodiment, temperature control unit 43 constitutes an automatic damper control arrangement, the basics of which are known in the art and therefore need not be detailed here. However, in general, control member 46 is used to set a desired temperature for fresh food compartment 8 by controlling the positioning of an automatic damper which regulates the flow of cooling air into fresh food compartment 8, while control member 47 is linked to a thermostat unit (not shown). It is the manner in which a flow of cooling air is developed and delivered to fresh food compartment 8 to which the present invention is particularly directed as will be detailed more fully below.

Figures 2, 2A:
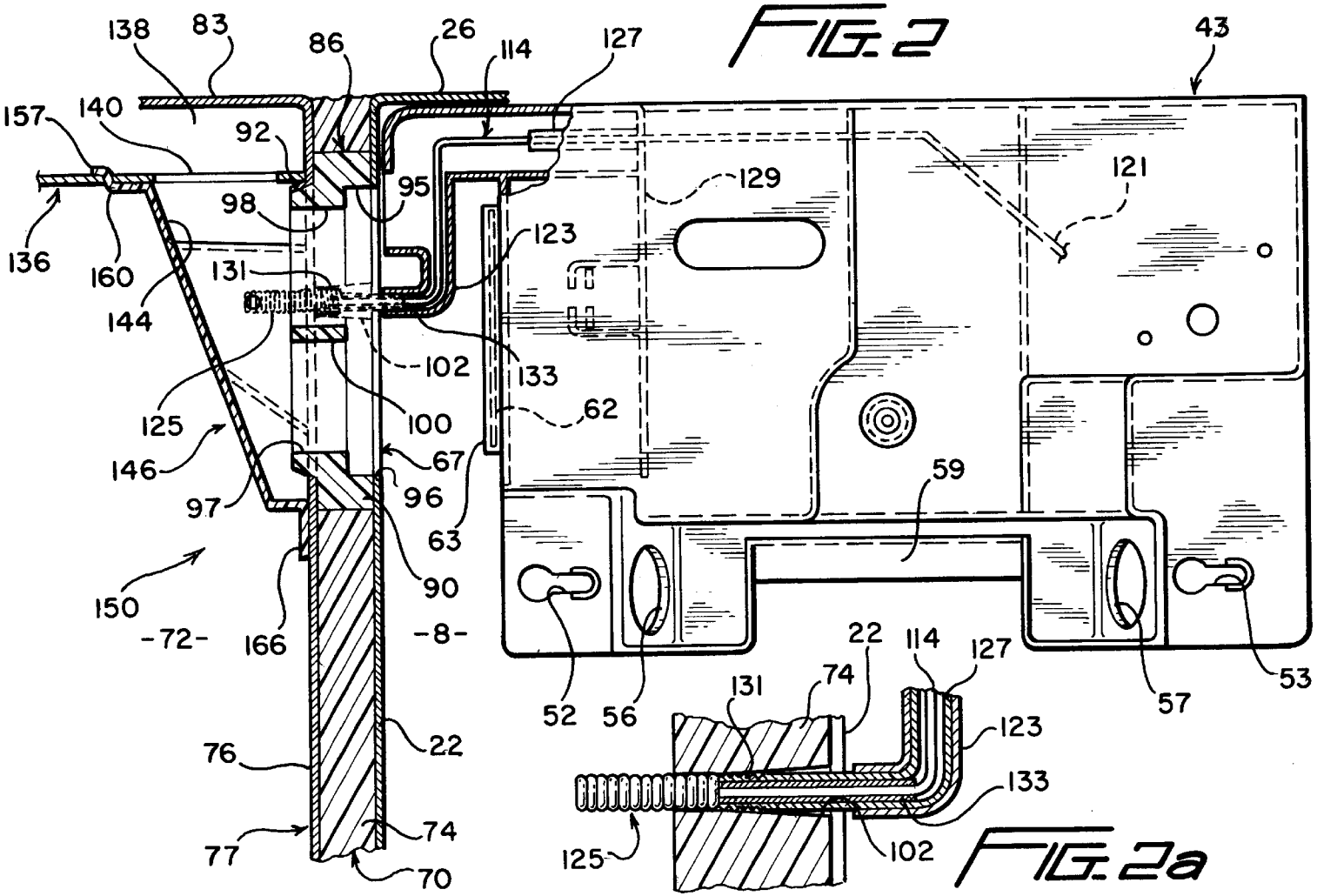
FIG. 2 is a partial cross-sectional top view of the present temperature control system arranged within an upper portion of the refrigerator of FIG. 1.
FIG. 2*a* is an enlarged cross-sectional view of a portion of the temperature control system of the invention.

FIG. 2 illustrates a partial cross-sectional top view of side-by-side refrigerator 2 and temperature control unit 43. As shown, temperature control unit 43 is provided with a pair of forward mounting slots 52 and 53 which are used, in combination with a screw (not shown) adapted to extend through control unit 43 and rear wall 26, to secure temperature control unit 43 atop fresh food compartment 8. Temperature control unit 43 is also shown to include a pair of spaced openings 56 and 57 arranged on either side of a recessed zone 59. Openings 56 and 57 are adapted to receive light fixtures for illuminating fresh food compartment 8 upon opening of side door 7. Recess zone 59 is adapted to accommodate the attachment of a housing for temperature control members 46 and 47.

At this point, it should be recognized that the particular construction of temperature control unit 43 is not an important aspect of the present invention and therefore can take many shapes and forms without departing from the invention. As is known in the art, temperature control unit 43 is adapted to support a pivoting automatic damper door or flap 62 which controls the rate of air flow into control unit 43 through a side opening 63. Side opening 63 is adapted to be connected by means of a duct member 65 (generally shown in FIG. 1) with a passageway 67 provided in a mullion 70 that separates fresh food compartment 8 from a freezer compartment 72. In a manner also known in the art, mullion 70 is generally constituted by side wall 22 of fresh food compartment 8, insulation 74 and a side wall 76 of a freezer liner 77 which defines freezer compartment 72. Obviously, only a portion of freezer liner 77 is depicted in this figure, i.e., only side wall 76 and a rear wall 83. As is also widely known in the art, fresh food liner 20 and freezer liner 77 are positioned within cabinet shell 3 and then insulation 74 is injected within mullion 70 to thermally insulate between fresh food compartment 8 and freezer compartment 72.

In accordance with the present invention, an air flow passageway defining insert 86 is generally positioned between liners 20 and 77 and held in place following the injection of insulation 74. Air flow passage defining insert 86 includes a first section 90 entirely positioned within the area of mullion 70 and a second section 92 which tapers to an end located within freezer compartment 72. First section 90 defines an enlarged passageway portion 95 that is aligned with an opening 96 formed in side wall 22 of fresh food compartment liner 20 and second section 92 includes a pair of fore-to-aft spaced sub-passageway portions 97 and 98 (also see FIG. 3). Sub-passageway portions 97 and 98 are separated by a vertical reinforcement member 100. In the most preferred form of the invention, air flow passageway defining insert 86 is made of foam so as to also constitute a good insulator. However, other materials could be readily used for insert 86 without departing from the spirit of the invention.

Insert 86 is also formed with a bore 102 which is aligned with corresponding apertures (not labeled) formed in side walls 22 and 76. In the preferred embodiment, bore 102 tapers from the opening in side wall 22 to the opening in side wall 76 as best shown in FIG. 2. In addition, mullion 70 and insert 86 are formed with an additional through hole 106, as clearly shown in FIG. 3, for electrical wiring purposes. As illustrated, both bore 102 and through hole 106 are offset from each other and passageway 67. Furthermore, side wall 76 of freezer liner 77 has formed therein an aperture 110 at a position forward of passageway 67 for the reason which will be outlined below.

Bore 102 is provided to enable a freezer temperature sensor 114 to be routed from temperature control unit 43 into freezer compartment 72 through mullion 70. In the preferred embodiment, temperature sensor 114 constitutes a capillary tube having a first end portion 121 connected to a thermostat (not shown) which forms part of temperature control unit 43. Freezer temperature sensor 114 is then routed through a conduit section 123 of temperature control unit 43, with a second end portion 125 of freezer temperature sensor 114 being coiled and projecting into freezer compartment 72 through bore 102. An insulation sleeve 127 is preferably placed about freezer temperature sensor 114 before second end portion 125 is coiled. In the embodiment shown, insulation sleeve 127 extends from a position against a molded rib 129 of the temperature control unit 43, through conduit section 123 and into bore 102. The length of insulation sleeve 127 is selected such that, as second end portion 125 of freezer temperature sensor 114 is inserted through bore 102, insulation sleeve 127 compresses such that a bulging terminal end 131 of insulation sleeve 127 develops in order to create a seal within bore 102 at the second end portion 125 of freezer temperature sensor 114.

Also placed about freezer temperature sensor 114 before coiling second end portion 125 is a rigid support sleeve 133 as best shown in FIG. 2*a*. Although support sleeve 133 could be made from various known materials, PVC is preferably utilized. More specifically, support sleeve 133 is placed over freezer temperature sensor 114 and under insulation sleeve 127 and extends between second end portion 125 and a radius portion of conduit section 123. With this arrangement, support sleeve 133 dictates the distance second end portion 125 extends from conduit section 123 of temperature control unit 43. In addition, support sleeve 133 maintains a terminal portion of freezer temperature sensor 114 fairly rigid so as to correctly locate second end portion.

Figure 3:
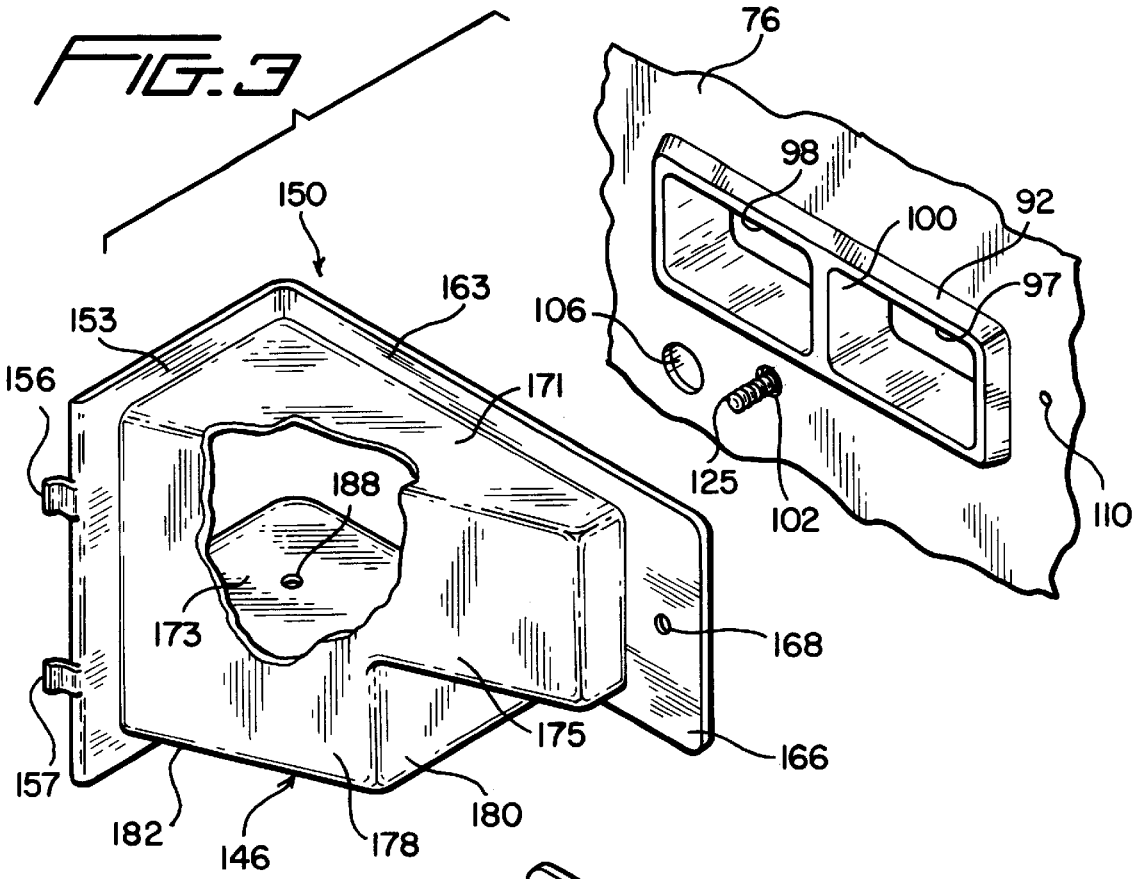
FIG. 3 is an exploded view of an air diverter and flow through passageway arrangement for directing cooling air from a freezer compartment to a fresh food compartment of the refrigerator of FIGS. 1 and 2.
Figure 4:
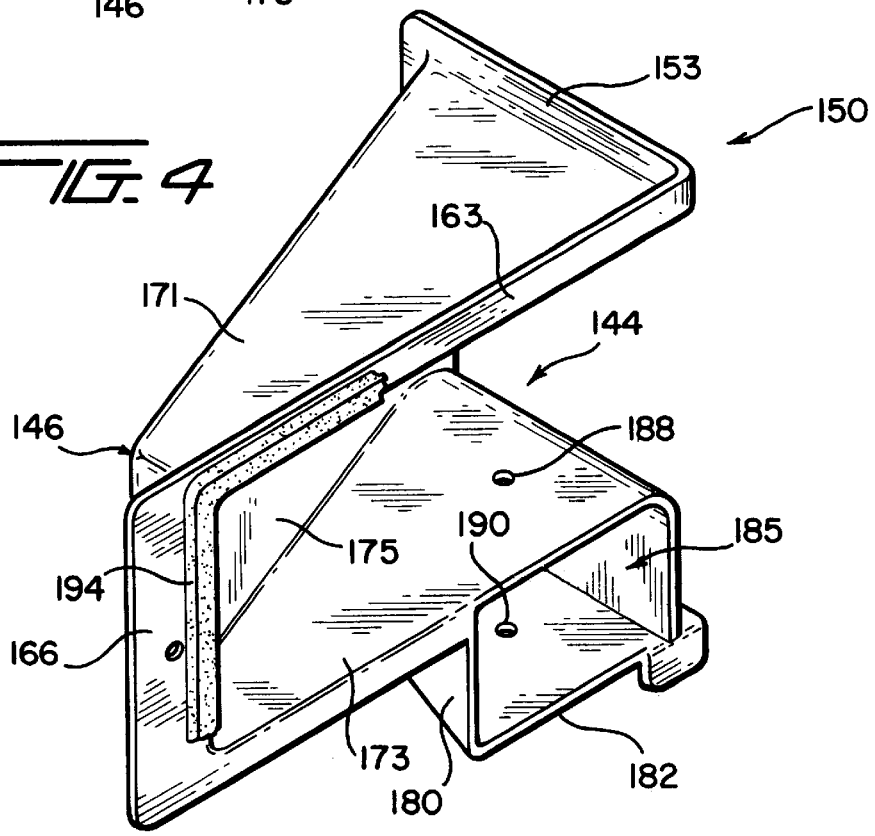
FIG. 4 is another perspective view of the air diverter of FIG. 3.

In the most preferred form of the invention, freezer compartment 72 has mounted therein a false rear wall 136 which is arranged forward of rear wall 83 of freezer liner 77 such that a space 138 is defined therebetween. Although not shown, false wall 136 generally extends the entire height of freezer compartment 72 and has mounted therein various components of a refrigeration circuit to develop a flow of cooling air within space 138. In the most preferred form of the invention, the overall false wall 136 is formed from an aluminum lower coil cover (not shown), a central, plastic fan cover (not shown) and an upper coil cover which is indicated in FIG. 2 with the general reference numeral 136. At this point, it should be recognized that the general construction of the false wall 136 is not a particular concern of the present invention. However, in this most preferred form, a portion of the cooling air developed within space 138 is delivered directly to freezer compartment 72, while some of the cooling air is directed through an opening 140 provided in false wall 136. Opening 140 leads to into a channel 144 defined by a housing 146 of a plastic diverter member 150. The arrangement of diverter member 150 relative to opening 140 is perhaps best shown in FIG. 2, however, FIGS. 3 and 4 are considered to best illustrate the overall construction of diverter member 150 as will now be detailed.

As illustrated, diverter member 150 includes a rear perimeter portion 153 which is adapted to be positioned against false wall 136. Rear perimeter portion 153 is also formed with a pair of spaced tabs 156 and 157, each of which is adapted to extend within a respective aperture formed in false wall 136, with one of the apertures being shown in FIG. 2 at 160. Housing 146 of diverter member 150 is also provided with a side perimeter portion 163 which is adapted to be positioned against side wall 76 of freezer liner 77. Side perimeter portion 163 includes a frontal extension 166 provided with a hole 168. In mounting of diverter member 150, housing 146 is initially angled to permit insertion of tabs 156 and 157 through the respective apertures 160 and then housing 146 is pivoted to assume the position shown in FIG. 2 wherein hole 68 is aligned with aperture 110 for receiving a mechanical fastener (not shown).

Channel 144 functions to guide cooling air to flow from space 138, through opening 140, to fresh food compartment 8 through passageway 67 defined by insert 86. Channel 144 is generally defined by an upper wall 171, a lower wall 173 and a side wall 175. Upper, lower and side walls 171, 173 and 175 generally taper forwardly from an inlet of channel 144 as clearly shown in these figures. Opposite side wall 175, channel 144 is open such that this zone defines an outlet which extends about second section 92 of insert 86.

With this arrangement, a flow of cooling air can be delivered from within space 138 of freezer compartment 72 to fresh food compartment 8 through channel 144 of diverter member 150 and passageway 67 defined by insert 86. Although not shown in FIG. 2, duct member 65 extends between side opening 63 and first section 90 of insert 86 such that the flow of cooling air is delivered to temperature control unit 43. In a manner known in the art, the shifting of temperature control member 46 for fresh food compartment 8 will control the opening of the automatic damper door 62. The actual cycling of the refrigeration circuit is established based on temperature signals delivered from sensor 114 to the thermostat of temperature control unit 43.

As indicated above, controlling a refrigeration circuit based on sensed temperature signals delivered to a thermostat unit is widely known in the art and does not form part of the present invention. However, it is important that the signals accurately reflect the actual sensed temperature of the air. This feature is accomplished in accordance with the present invention through various aspects which combine to produce synergistic results. More specifically, the coiling of the second end portion 125 of freezer temperature sensor 114 results in a rather large temperature sensing surface with a compact configuration. The presence of insulation sleeve 127, preferably made of ARMAFLEX, effectively insulates the fresh food portion of the capillary tube so that condensation and conduction to second end portion 125 are minimized.

In and of themselves, these features are considered to represent important aspects that enhance the effectiveness of the temperature control system of the present invention. However, it is also desired to protect the second end portion 125 of temperature sensor 114 from objects within freezer compartment 72 and, at least under certain conditions, prevent the sensor 114 from warming up too quickly which could cause a motor protector provided on a convention compressor of the refrigeration circuit to trip. Therefore, housing 146 of diverter member 150 is also preferably provided with a side wall extension 178, a front wall 180 and a lowermost wall 182 which, combined with a portion of lower wall 173, defines a specialized chamber 185. When diverter member 150 is secured over passageway 67, the second end portion 125 of freezer temperature sensor 114 projects into chamber 185. In essence, chamber 185 is sealed from channel 144 except for the provision of a bleed hole 188 which extends through the common portion of lower wall 173. Chamber 185 is also provided with a secondary hole 190 formed in lowermost wall 182. With this arrangement, a regulated flow of air is permitted to flow through chamber 185 by entering bleed hole 188 and exiting secondary hole 190. It is this regulated flow of air that second end portion 125 of temperature sensor 114 is subjected to and it is the temperature of this regulated flow of air which is measured and used to control the cycling of the refrigeration circuit.

Based on the above, the coiling of second end portion 125 of temperature sensor 114, the provision of insulation sleeve 127 and the arrangement of second end portion 125 within chamber 185 contribute to providing an extremely effective and accurate temperature sensing arrangement for the control system of the present invention. Since the sensor 114 is located within the specialized chamber 185, sensor 114 is protected from being inadvertently damaged by contact with items placed in freezer compartment 72. In addition, by the positioning of sensor 114 within chamber 185 and regulating the exposure of sensor 114 to the flow of cooling air, sensor 114 has been found to warm at a controlled rate such that the cycling of the refrigeration circuit can be minimized. The conical shaping of bore 102 is provided not only to enable insulation sleeve 127 to become compressed in order to create a seal, but also is sized only slightly larger than the coiled second end portion 125 of temperature sensor 114 such that the second end portion 125 is maintained in a predetermined position. For sealing purposes, diverter member 150 can also be provided with a perimeter seal or gasket 194 (not shown in FIG. 2 but illustrated in FIG. 4), which preferably extends entirely about rear perimeter portion 153, side perimeter portion 163 across frontal extension 166 and along lower wall 173 such that the entire engagement surfaces between diverter member 150 and both side wall 76 of freezer liner 77 and false wall 136.

Although described with respect to a preferred embodiment of the present invention, it should be readily understood that various changes and/or modifications can be made to the invention without departing from the spirit thereof. For instance, although the present invention illustrates a particular construction for the diverter member 150 and a preferred arrangement for the delivery of air from freezer compartment 72 to fresh food compartment 8, various other air diverting arrangements for use in guiding the flow of cooling air could also be utilized without departing from the spirit of the invention. However, it is considered important that the temperature sensor 114 be exposed to a regulated flow of the cooling air in order to avoid windage factors in the temperature readings. In general, the invention is only intended to be limited by the scope of the following claims.

We claim:

1. In a refrigerator including a freezer compartment and a fresh food compartment separated by a partition having a passageway there through for permitting a flow of cooling air from the freezer compartment to the fresh food compartment, a temperature control system comprising:

a diverter member including a housing arranged at the passageway, said housing defining a channel for guiding cooling air to flow from the freezer compartment to the fresh food compartment through the passageway and a chamber in fluid communication with the channel;

a temperature control unit mounted in the refrigerator; and a temperature sensor for signaling freezer temperatures to the temperature control unit, said temperature sensor having a first end portion positioned in the chamber of the diverter member and a second end portion routed to the temperature control unit.

2. The temperature control system according to claim 1, wherein the channel and the chamber have at least one wall therebetween and the chamber is in fluid communication with the channel through a bleed hole extending through the at least one wall.

3. The temperature control system according to claim 2, further comprising: a secondary hole opening into the chamber, wherein the bleed hole and the secondary hole permit the flow of cooling air from the freezer into and out of the chamber respectively.

4. The temperature control system according to claim 2, wherein the channel includes an air inlet and an air outlet, with the air outlet being aligned with the passageway, and wherein the chamber is arranged offset from the passageway.

5. The temperature control system according to claim 4, wherein the at least one wall constitutes a common side wall for both the channel and the chamber and wherein the bleed hole is formed in the common side wall between the air inlet and air outlet of the channel.

6. The temperature control system according to claim 4, further comprising: a bore extending through the partition at a position spaced from the passageway, said sensor extending through the bore and into the chamber.

7. The temperature control system according to claim 2, further comprising: an insulation sleeve extending about at least a portion of the temperature sensor.

8. The temperature control system according to claim 7, further comprising: a support sleeve arranged about an end section of the temperature sensor.

9. The temperature control system according to claim 8, further comprising: a bore extending through the partition at a position spaced from the passageway, said sensor extending through the bore and into the chamber, said supporting sleeve extending from within the temperature control unit to directly adjacent the first end portion of the temperature sensor.

10. The temperature control system according to claim 9, wherein the insulation sleeve forms a seal for the bore.

11. The temperature control system according to claim 9, wherein the temperature sensor comprises a capillary tube.

12. The temperature control system according to claim 11, wherein the first end portion of the capillary tube is coiled within the chamber.

13. The temperature control system according to claim 2, wherein the partition is defined by liners for the freezer and fresh food compartments which are spaced by an insulation zone and wherein the temperature control system further comprises, in combination, an insert positioned between said liners, said insert defining said passageway.

14. The temperature control system according to claim 13, wherein said insert is formed of foam.

15. The temperature control system according to claim 13, further comprising: a bore formed in said insert at a position spaced from said passageway, said temperature sensor extending through said bore.

16. The temperature control system according to claim 15, further comprising: a through hole formed in said insert for use in routing electrical wires to said temperature control unit, said through hole being spaced from both the passageway and the bore.

17. The temperature control system according to claim 15, further comprising: an insulation sleeve extending about at least a portion of the temperature sensor and wherein the insulation sleeve forms a seal for the bore.

18. The temperature control system according to claim 2, further comprising: a liner, including a rear wall portion, defining the freezer compartment and a false wall positioned across a rear portion of the freezer compartment forward of the rear wall portion of the liner so as to define a space therebetween, said false wall including an opening leading to said channel, wherein a flow of cooling air generated between the false wall and the rear wall portion of the liner is introduced into the channel of the diverter member through said opening.

19. The temperature control system according to claim 18, wherein the channel includes an air inlet and an air outlet, with the air outlet being aligned with the passageway, and wherein the chamber is arranged offset from the passageway.

20. The temperature control system according to claim 2, further comprising: a peripheral seal member interposed between the housing of the diverter member and the partition for sealing the channel around the passageway.

* * * * *